United States Patent [19]

Kazuhide

[11] 4,059,058

[45] Nov. 22, 1977

[54] REDUCIBLE VOLUME DESK

[75] Inventor: Takahama Kazuhide, Bologna, Italy

[73] Assignee: Simon International S.p.A., Bologna, Italy

[21] Appl. No.: 716,935

[22] Filed: Aug. 23, 1976

[30] Foreign Application Priority Data

Apr. 9, 1976 Italy ..... 3396/76

[51] Int. Cl.[2] ..... A47B 3/08

[52] U.S. Cl. ..... 108/129; 108/132; 16/135

[58] Field of Search ..... 108/129, 131, 132, 133, 108/124, 127, 156; 312/195; 16/135, 128 R; 248/188.6, 439

[56] References Cited

U.S. PATENT DOCUMENTS

| | | | |
|---|---|---|---|
| 155,999 | 10/1874 | Valley | 108/131 |
| 1,133,109 | 3/1915 | Derbyshire | 108/132 |
| 2,887,348 | 5/1959 | Sadowsky | 108/124 |
| 3,469,276 | 9/1969 | Dickson | 16/135 |
| 3,838,902 | 10/1974 | Tenani | 108/131 X |

*Primary Examiner*—Francis K. Zugel
*Attorney, Agent, or Firm*—Browdy and Neimark

[57] ABSTRACT

Disclosed herein is a reducible volume desk, or in other words, a desk whose volume can be reduced with the utmost ease so that, at the time it is being transported, it takes up the least possible space. Subsequently, in an extremely short period of time, the desk can be reassembled in its final configuration with the certainty that all of its component parts are available.

The desk is essentially composed of a first member, or support platform, to the underneath part of which are connected two second members that define the lateral walls and a third cross member perpendicular thereto; the said second and third members being foldable, one on the other, in parcel form, on the lower surface of the support platform.

1 Claim, 11 Drawing Figures

REDUCIBLE VOLUME DESK

BACKGROUND OF THE INVENTION

This invention relates to a reducible volume desk.

DESCRIPTION OF THE PRIOR ART

The requirement that the invention in question is able to satisfy stems principally from the fact that the desks known to date offer various ways in which they can be dismantled into their basic parts so that they take up the least possible space and thus make their transportation easier.

This results in there being a considerable amount of time wasted at the time the desks are being assembled due both to the parts concerned having to be put together and to one or more of the connecting pieces used to fix one part to another frequently not being available.

SUMMARY OF THE INVENTION

An essential object of the present invention is, therefore, to design a desk, the overall dimensions of which can be reduced in an extremely simple way so that it takes up the least possible space when being transported and that it can subsequently be reassembled, in an extremely short period of time, in its final configuration, with the certainty that all of its component parts are available.

Another object of the present invention is to design a desk able to satisfy the foregoing in an extremely simple way and, above all, cheap in cost.

These and other objects too have all been attained with the desk according to the present invention, essential features of which are that it comprises: a first member that acts as a support platform; two second members connected perpendicularly to the aforementioned first member in such a way as to define two parallel walls supporting the first member; and a third member that acts as a wall and is connected to the lower surface of the support platform and, perpendicularly, to the above mentioned second members; the said second and third members being foldable, one on the other, in parcel form, on the lower surface of the support platform.

BRIEF DESCRIPTION OF THE DRAWINGS

Further characteristics and advantages of the invention will emerge more clearly from the following detailed description of a preferred but not the sole form of embodiment for the desk in question, illustrated as purely an unlimited example on the accompanying drawings on which.

DESCRIPTION OF THE PREFERRED EMBODIMENT

Figure 1:
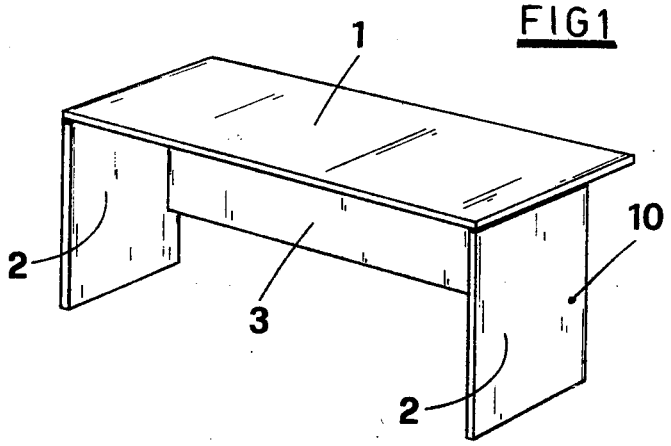
FIG. 1 shows the desk in question in a front perspective view.

With reference to the accompanying figures, it can be seen that the desk in question is essentially formed by three distinct basic members, viz. a rectangular upper surface 1, two members or lateral walls 2, connected vertically to the extremities of the surface 1 at a point corresponding to each of its short sides and a flat cross member 3 connected vertically to the underneath part of the surface 1, perpendicularly to the lateral walls 2.

The connection of the lateral walls 2 and 3 to the flat surface 1 is by means of hinges. To be more precise, the cross member 3 is connected to the underneath part of the support platform 1 through a number of hinges 4 in such a way that it be possible for the aforementioned member 3 to be folded completely in parcel form onto the member 1 (see FIGS. 2 and 3). Likewise, the lateral walls 2 are conected to the surface 1 through suitable hinges which can be seen in particular in FIGS. 4, 5 and 6.

Figure 3:
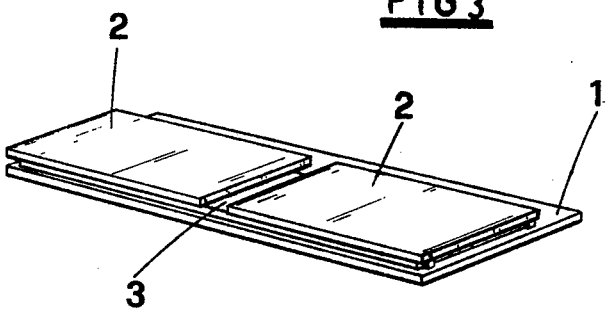
FIG. 3 shows, in a perspective view, the desk folded right up into the position in which it takes up the least space.

The use of these is necessary in order to allow the said walls 2 to be folded and superposed above the cross member 3 in the way shown in FIG. 3.

The said hinges (in this particular case two per side wall 2) comprise a first body 5, essentially of "T" shape which, through a flange 5' can be fixed to the underneath part of the surface 1 at a point corresponding to its lateral corners and a second body 6 which can be fixed to the lateral wall 2 and so shaped that in a complementary fashion it goes round the free flange 5" of the body 5.

Figure 5:
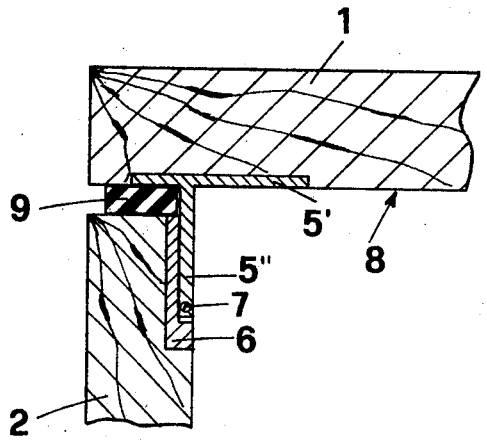
FIGS. 5 and 6 show diagrammatically, in sectional form, the hinge illustrated in FIG. 4 with the lateral member of the desk opened as far as it will go and with it partly folded.
Figure 6:
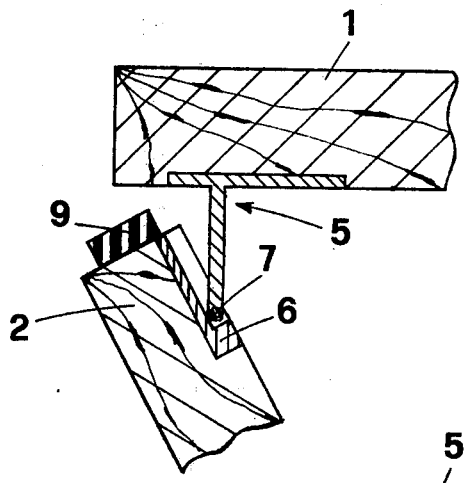
Figure 4:
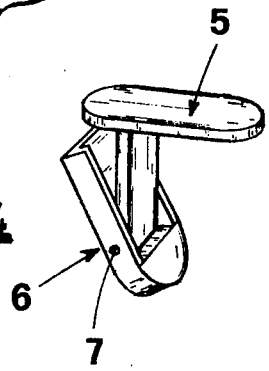
FIG. 4 shows, in a perspective view, one detail of the desk in question, that is to say, a detail of a hinge connecting one of the lateral members to the support platform, in its partly folded position.

As can be seen in FIG. 4, the second body 6 is pivotally connected to the first body 5 by a pin 7, the axis of which is perpendicular to the plane in FIGS. 5 and 6 and is parallel both to the plane of the member 1 and to that of the member 2.

The distance the axis of the pin 7 is away from the underneath part 8 of the surface 1 is calculated to suit the thickness of the cross member 3, that is to say, to allow the members 2 to be folded above the member 3 once this, as previously seen, has been folded in parcel fashion onto the surface 1 (see FIG. 3).

The linear member 9 which stretches over the full width of the lateral walls 2, preferably made of plastic material and visible in particular in FIGS. 5 and 6, has the sole task of preventing there being any possible constructional and/or assembly discontinuity between the surface 1 and the side walls 2 at the time the desk is fully opened up.

The opening of the desk takes place in the following manner: the lateral walls 2 are opened until they are in their vertical position, that is to say, until they are perpendicular to the support platform 1 and the cross member 3 is rotated into the final position shown in FIG. 1. The assembly of the desk is completed with the insertion of two fastening members 10, which are generally screws, with which the walls 2 are locked to the cross member 3.

Figure 7:
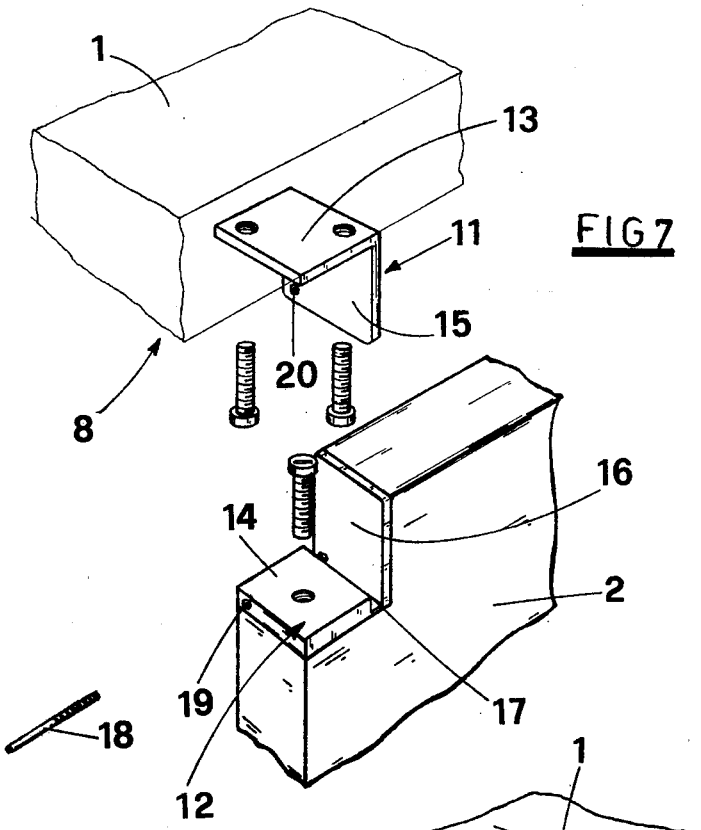
FIGS. 7 and 8 show, in perspective view form, an alternative to the hinge depicted in the preceding figures, the former in an exploded view and the latter, in the partly folded position of the lateral member of the desk.
Figure 8:
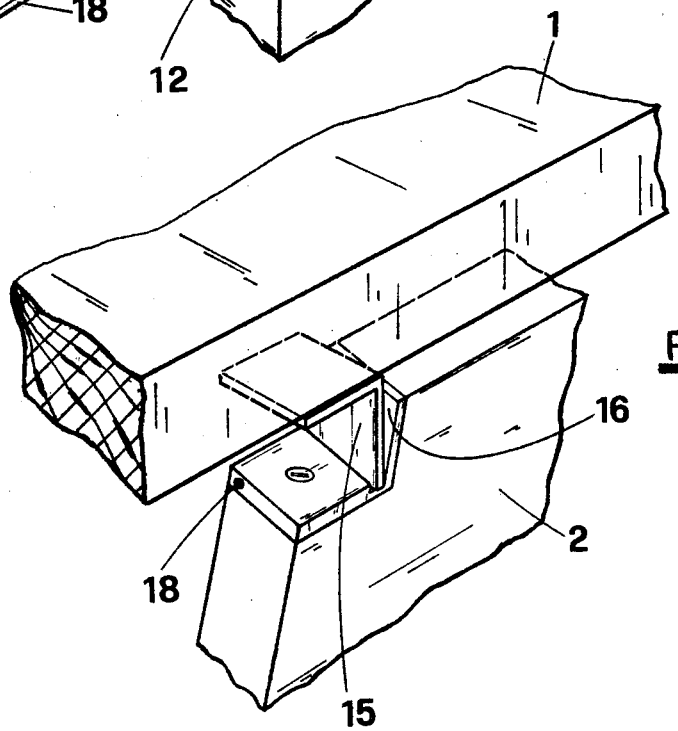

In FIGS. 7 and 8 which show an alternative form of embodiment for the hinge previously described in FIG. 4, the bodies 5 and 6 are replaced with equivalent bodies 11 and 12, the former, virtually of "L" shape being fixed, through its flange 13, to the underneath part 8 of the support platform 1, whilst the body 12, also substantially of "L" shape, is fixed integrally, through its flange 14, in a housing provided for this purpose in the upper border of the lateral wall 2, in such a way that the free flanges 15 and 16 of the said first and second body are parallel and adjacent.

Corresponding to where the inner corner of the second body 12 is located, a housing 17 is machined and inside this is inserted, in a complementary fashion, the extremity of the free flange 15 of the first body 11. A pin 18 which can be inserted inside a hole 19 in the second body 12 and be, for example, screwed into a corresponding hole 20 in the first body 11, provides the hinged connection between the aforementioned first body 11 and the aforementioned second body 12. The distance the axis of the said pin 18 is away from the underneath surface of the support platform will naturally be identical to the thickness of the said third cross member.

Figure 2:
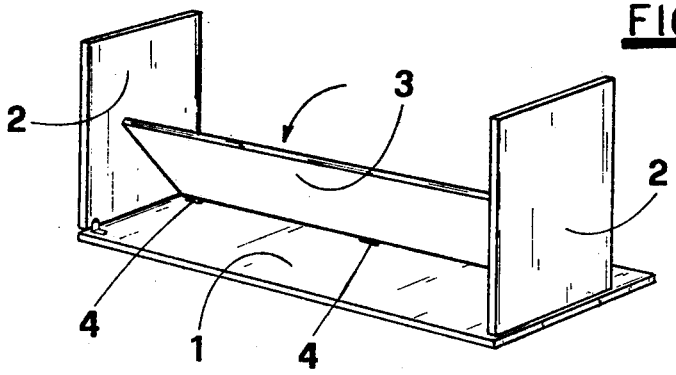
FIG. 2 shows the desk in question upside down in a front perspective view.
Figure 9:
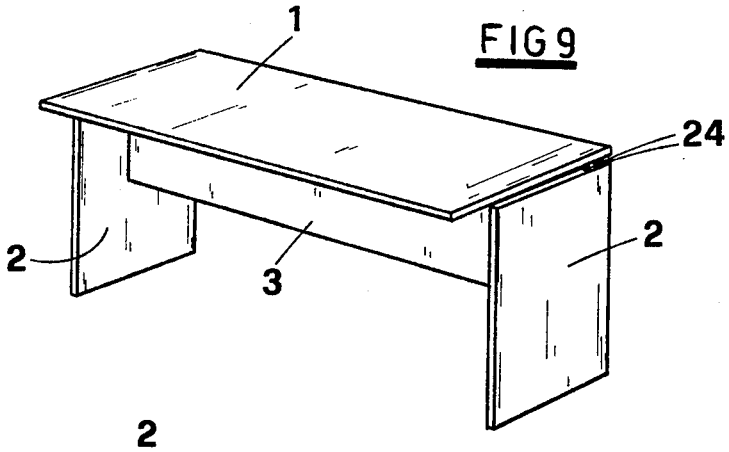
FIGS. 9, 10 and 11 show, in perspective view form, an alternative way in which the desk in question can be constructed (see FIGS. 1, 2 and 3) and depict it seen from the front, seen from the rear, partly folded when upside down, and seen from the rear, fully folded when upside down.
Figure 10:
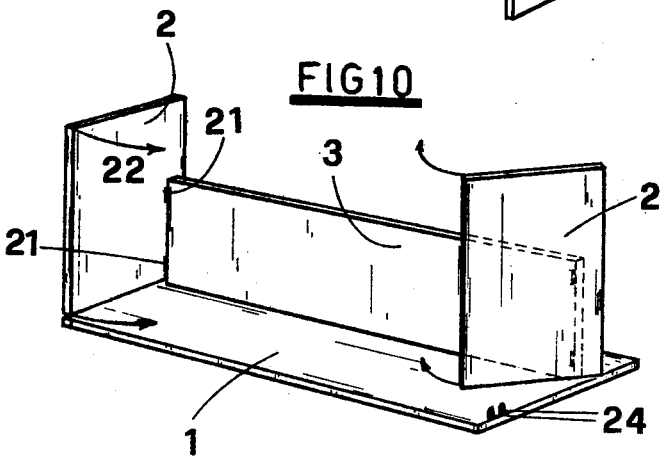
Figure 11:
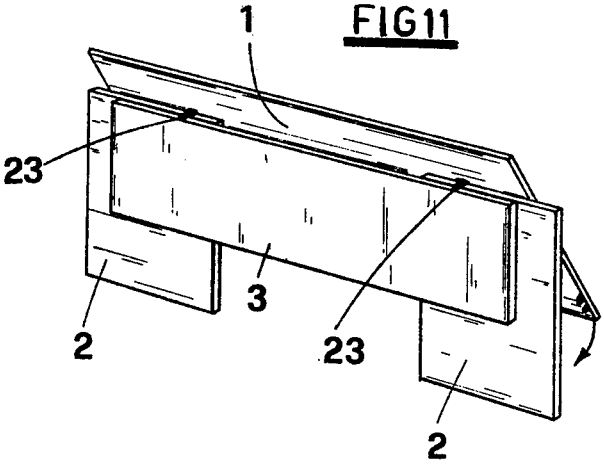

In FIGS. 9, 10 and 11 an alternative solution to that depicted in FIGS. 1, 2 and 3 is offered and, to be more precise, a desk is illustrated in which the members 1, 2 and 3 are folded in parcel form, one on top of the other but in a different folding order. The lateral walls in this case are, in fact, hinged to the cross member 3 at a point corresponding to where the corner 21 is located (see FIG. 10) and they fold thereon in the direction indicated by the arrows 22 shown in FIG. 10.

The cross member 3 is connected to the underneath part of the surface 1 through a certain number of hinges 23 and these obviously have to be suitably long to allow the contemporaneous folding of the walls 2 and 3.

The locking of the desk in its open position is, in this case, achieved through locking members 24 fixed to the surface 1 which can be inserted, corresponding to the configuration shown in FIG. 9, in corresponding holes machined in the corner of the wall 2.

From the foregoing description it can clearly be seen that the desk forming the subject of the present invention satisfies the objects outlined herein, particularly as regards the extremely simple way in which the desk can be assembled and dismantled, thereby consequentially rendering its transportation easier and providing assembly certainty because of the lack of parts that can be separated one from the other.

In its practical form of embodiment, the invention may also assume forms which differ from what has been described and illustrated herein and, in particular, numerous modifications of a practical nature may be made to the constructional details without this in any way deviating from the protection afforded to the present invention.

What is claimed is:

1. A reducible volume desk comprising a first member (1) which acts as a support platform; two second members (2) connected perpendicularly to the aforementioned first member to define two parallel walls supporting the first member; and a third member (3) which acts as a wall and is connected to the lower surface of the support platform and, perpendicularly, to the above-mentioned second members; said second and third members being foldable, one on the other, in parcel form, on the lower surface of the support platform; and wherein said third and the said second members are conected by hinges to the lower surface of the support platform in such a way that said third member can be folded, in parcel form, on the lower surface of the support platform and that said second members can be folded onto the previously folded third member, the connection between said third and said second members being removable; and wherein each said hinge connecting the second members to the support platform includes: a first body (11), virtually of "L" shape, a first flange (13) of which is fixed integrally to the lower surface of the support platform of the desk; and a second body (12), virtually of "L" shape, a first flange (14) of which is fixed integrally in a notch provided for this purpose in the upper border of one of said second members, said first flanges of said first and second body being arranged parallel to one another and second free flanges (15) and (16), respectively, being parallel and adjacent; said second body being provided, at a point corresponding to where the first flange (14) joins with the second free flange (16), with a slot (17) inside which is inserted, in a complementary fashion, an extremity of the free flange (15) of said first body; a hinge connection pin (18), the axis of which is parallel both to the plane of said first member and to that defined by said second member, passing through the first flange (14) of the second body (12) in a direction toward the second flange thereof and into a vertex of said extremity of the free second flange (15) of the first body and through said slot (17), the distance the axis of said pin is away from the lower surface of the support platform being no less than the thickness of said third member.

* * * * *